United States Patent [19]

Starr

[11] 4,166,264

[45] Aug. 28, 1979

[54] INTRUSION DETECTION TRANSDUCERS

[75] Inventor: James B. Starr, St. Paul, Minn.

[73] Assignee: Honeywell Inc., Minneapolis, Minn.

[21] Appl. No.: 864,966

[22] Filed: Dec. 27, 1977

[51] Int. Cl.[2] ..... H01F 27/30

[52] U.S. Cl. ..... 336/20; 336/181; 340/38 R; 340/551; 340/566

[58] Field of Search ..... 336/20, 180, 181, 170, 336/171, 234; 340/566, 38 R, 38 L, 666, 551; 323/48, 49

[56] References Cited

U.S. PATENT DOCUMENTS

| | | | |
|---|---|---|---|
| 3,173,112 | 3/1965 | Welch | 336/180 X |
| 3,257,949 | 6/1966 | Mead | 336/181 X |
| 3,747,036 | 7/1973 | Erdmann | 336/181 X |
| 3,754,223 | 8/1973 | Shtrikman | 340/38 L X |
| 3,846,790 | 11/1974 | Erdmann et al. | 340/566 X |
| 4,001,745 | 1/1977 | Goodman | 336/180 X |

*Primary Examiner*—Thomas J. Kozma
*Attorney, Agent, or Firm*—John S. Munday

[57] ABSTRACT

The invention comprises a plurality of intrusion detection transducers connected together wherein each transducer has a central core extending along an axis and having a length along that axis defined as XL where X is an even number of at least two and L is a given length. At least one sensing winding wire is wound around the core to provide a first-hand winding of L/2 length, X−1 number of windings of length L, and a second end winding of L/2 length, each adjacent winding being a reverse polarity to the next adjacent winding. Means are provided to connect each transducer to the adjacent transducers such that the first end of one transducer connects to the second end of the adjacent transducer.

13 Claims, 7 Drawing Figures

INTRUSION DETECTION TRANSDUCERS

The invention herein described was made in the course of or under a contract or subcontract thereunder (or grant) with the Department of the Air Force.

BACKGROUND OF THE INVENTION

Intrusion detection is becoming more important, both from a military standpoint and from a commercial activity. Military bases and installations, factories, power stations, stores, and even private homes are being protected by sophisticated electronic surveillance systems which are capable of monitoring the periphery of the facility so as to warm against unwanted intrusion.

One type of intrusion detection which has become more important in this security conscious world is that where a sensing element is concealed in the ground around the outer edges of an area to be protected. The sensing element of whatever type is adapted to monitor the movement of persons or objects approaching the outer edge, usually producing a signal indicating such an intrusion.

To enhance the value of any intrusion detection system, it is desirable that the sensor be able to detect more than one form of intrusion. Specifically, magnetic intrusion is normally detected, such as, for example, by detection of a mass of metal which breaks through or encroaches on a magnetic field. Objects which might be detected by these devices are obvious metal products such as vehicles, weapons, tools, and the like. Examples of patents which disclose sensors capable of detecting intrusion by metallic objects are U.S. Pat. No. 3,747,036 and U.S. Pat. No. 3,754,223.

While detection of intrusion by the aforementioned type is likely to give a reasonable degree of assurance, additional protection is desired if it can be achieved without greatly increasing cost and technical difficulties. Obviously, watchmen or sentries can be placed around an area to be guarded, but this is an expensive and not always reliable safeguard. Remote control cameras and other visual sensors bring about additional costs. Intrusion detection sensors have been developed which permit the use of already existing magnetic apparatuses. These intrusion detection systems detect intrusion by recognition of near-field surface disturbances so as to intercept and detect non-metallic objects moving across the line to be guarded. An example of a patent which discloses sensors capable of detecting near-field surface disturbances is U.S. Pat. No. 4,001,745.

Nevertheless, if the area to be protected is substantial in the size, or if the surface under which the sensor is to be buried varies in density or compactness, difficulties can arise in providing a sensor capable of completely surrounding the area to be detected. For example, when a relatively large area is to be surrounded by an intrusion detection sensor, it would be practical to attach a plurality of sensors together in series, both for reasons of ease of manufacture and for convenience in installation. However, at that point where two intrusion detection transducers are joined together, the sensitivity of the line sensor may be substantially less since, at the connecting area, there is no intrusion detection mechanism. Accordingly, in an intrusion detection system which uses a plurality of intrusion detection transducers, several weak points in the line may exist at these connecting points.

Oftentimes, when a relatively large area is being protected by an intrusion detection line, the area is comprised of more than one type of surface. Specifically, for example, part of the perimeter being protected could be comprised of ordinary dirt or earth while other areas might be paved or covered over by materials which yield little to surface loads when compared to the earth or other portions of the perimeter. It is impossible to provide an increased sensitivity in these areas of low seismic or pressure transmission without simultaneously increasing the sensitivity of the less sensitive area to a point where remote or background disturbances cause unwanted false alarms.

Accordingly, it is an object of this invention to provide a plurality of transducers which can be connected together without danger of significant insensitivity at their junctions.

Another object of this invention is to provide a means for increasing the relative sensitivity of one transducer in a line of plurality of transducers to permit adjustment for various media in which the line transducer is buried.

Other objects will appear hereinafter.

A BRIEF DESCRIPTION OF THE INVENTION

It has now been discovered that the above and other objects of the present invention may be accomplished in the following manner. Specifically, it has now been discovered that a plurality of transducers may be connected together in the following manner. A central core is provided for each transducer extending along an axis and having a length along that axis defined as XL, where X is an even number of at least two, and L is a given length. At least one sensing winding wire is wound around each core to provide a first end winding of L/2 in length, X-1 number of windings of length L, and a second end winding of L/2 winding. End windings of all transducers are in the same direction. Each adjacent winding is of reverse polarity to the next adjacent winding. Finally, means are provided for connecting each transducer to the adjacent transducer such that the first end of one transducer connects to the second end of the adjacent transducer.

As a preferred embodiment, the core should be formed from a magnetostrictive material. In one embodiment, the core comprises a flat solid core having a substantial width to thickness ratio. In another embodiment of the present invention, the core comprises a plurality of magnetostrictive wires woven together to form a substantially round core of a significantly greater diameter than the diameter of the individual wires. The value for X will be at least 2, and in many cases at least 20, and the length L can range, preferably, from ½ meter to 4 meters.

Jacketing means are also preferably provided to permit protection of the device in its intended installation. When a substantially flat, solid core is employed, the jacketing means should include a pair of flat portions covering the core across the width of the core and end portions joining said pair of flat portions at both edges of the core, wherein the end portions have at least a part thereof perpendicular to the first portions.

Regardless of which type of core is employed, it is preferred that the wires be wound around the core at a predetermined tightness to permit magnetostrictive movement of the core. In a preferred embodiment, one sensing winding wire is wound around the core in alternating reversals of the windings to form a first end winding, X-1 number of middle windings, and a second end winding. Each adjacent winding is of a reverse polarity with respect to the next adjacent winding. It is also preferred to employ at least two sensing winding wires alternately wound around the core to form a first end winding, X-1 numbers of middle windings, and the second end winding such that each adjacent winding is a reversible polarity to the next adjacent winding.

Each transducer can be of different sensitivity than the sensitivity of an adjacent transducer. Sensitivity may be adjusted by varying the number of windings of wire about the core per linear centimeter.

DETAILED DESCRIPTION OF THE INVENTION

In a preferred embodiment of this invention, the core itself is formed of stress-sensitive magnetostrictive material such as Permalloy. A preferred minimum stress-sensitivity coefficient is at least 0.1 Maxwells per pound.

In one embodiment of the present invention, it is preferred that the core be a flat solid core having a substantial width to thickness ratio, such as in the order of at least 8 to 1. Alternately, another embodiment of this invention provides for a core which comprises a plurality of magnetostrictive wires woven together to form a substantially round core of significantly greater diameter than the diameter of the individual wires. Typical lengths of both types of cables may range to as great as 100 meters or more. It is preferable to construct a transducer where X is at least 2, and preferably 20, and L ranges from ½ meter to 4 meters. For particular installations, substantially shorter or longer cables with other values of X may be employed, as long as X is an even number.

Normally, the transducer of the present invention is intended to be buried in the ground or otherwise positioned so as to be located in an environment which necessitates some protection of the core from the environment. It is a preferred embodiment that the transducer core include a jacketing means surrounding the coils on the core for preventing contact of the core with the external environment. The jacketing means should be sufficiently durable to prevent corrosive or erosive attack by the environment and should be capable of withstanding normal attack by rodents and other wildlife. One preferred jacketing means, particularly suitable with the flat core having a substantial width to thickness, includes a pair of flat portions covering the coils across the width of the core and end portions adjoining the pair of flat portions at both edges of the core. The end portions should have at least a part thereof perpendicular to the first portion.

In the case of a round cable, the jacketing means may be comprised merely of a wrapping of impervious material which is wrapped around the coils on the core to prevent contact of the coils with external environment and to maintain a predetermined pressure on the core through the coils.

In addition, the wires themselves as they are formed into coils, may be wound at a predetermined tightness to enhance magnetostrictive movement of the core.

The output from the transducers of this invention may be connected to various intrusion detection electronic systems, such as, for example, that disclosed in U.S. Pat. No. 3,846,790.

For a more complete understanding of the present invention, reference is hereby made to the drawings in which.

Figure 1:
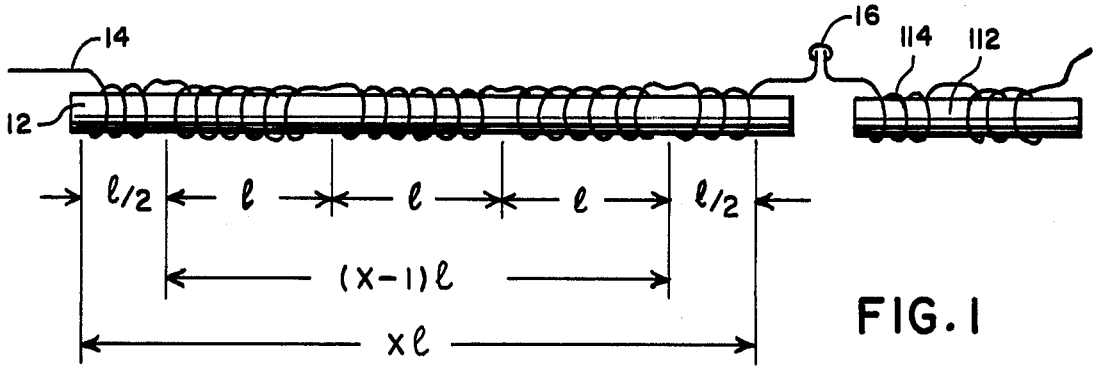
FIG. 1 represents a schematic drawing showing one embodiment of the present invention.

As shown in FIG. 1, a transducer 12 extends along an axis having a length XL. The transducer is wrapped by a wire 14 such that windings are formed on the core 12. The first end winding has a length of L/2, three additional windings of lengths L are provided, and a final winding at the second end has a length of L/2. For this embodiment, X represents 4 and L can be any number which is convenient for the purposes intended. As stated above, it is preferred that L range from ½ meter to 4 meters. A value of X=4 has been selected for simplicity sake. As can be seen in FIG. 1, the windings of the wire 14 are of reverse polarity for each adjacent winding with respect to the next adjacent winding. Since X is always an even number, and the middle section contains 1-X windings, the polarity of the first end and the second end are identical. Thus, when connector 16 is employed to connect wire 114 surrounding core 112, the polarity of the second end of core 12 is the same as the first end of core 12. Connector 16 has been shown with the cores 12 and 112 apart, but it is to be understood that proper connection will have the cores as close as possible and preferably in operable contact, to provide continuity of detection.

Figure 2:
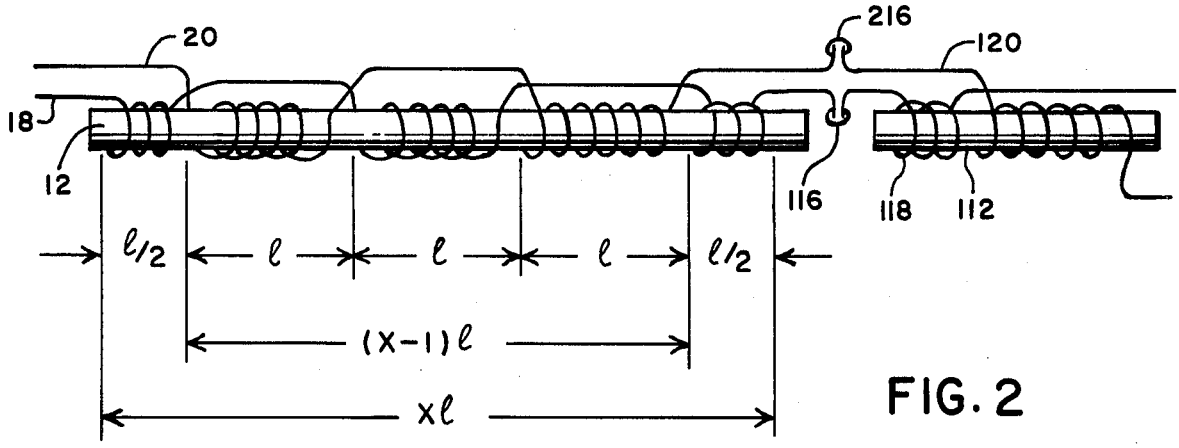
FIG. 2 represents another schematic drawing showing embodiment of the present invention.

Similarly, shown in FIG. 2 is a core 12 having a length of XL. Again, for the purpose of simplicity, X has been chosen to be 4. Wire 18 is wrapped about the core 12 for a length of L/2 at both ends of the core 12. Wire 18 is also wrapped about core 12 to get a winding of length L in the middle of the transducer. In addition, the second wire 20 is wrapped about the core 12 to give a winding of length L adjacent to, but of opposite polarity to, the winding at the first end of core 12. Wire 20 is further wrapped about core 12 to give a second winding of reverse polarity to that of the winding from wire 18 at the second end of the core 12. Connectors 116 and 216 connect wires 18 and 118 and wires 20 and 120 respectively. Again, the cores 12 and 112 are to be operably connected for continuity of detection. Shown on core 112 is a winding 118 which is of the same polarity as that of the second end winding on core 12. In each case, each adjacent winding is of the reverse polarity to that of the next adjacent winding.

Figure 3:
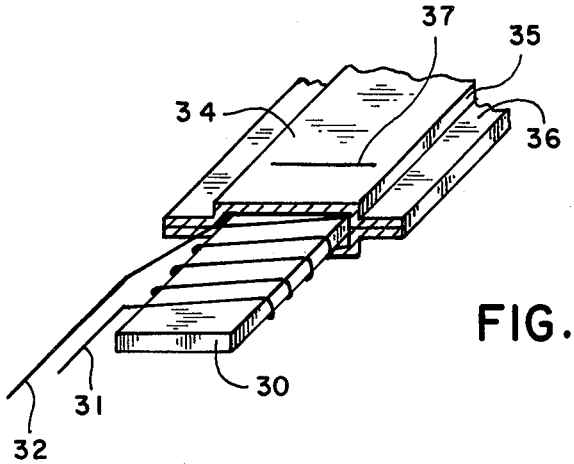
FIG. 3 is a partially sectioned cutaway schematic drawing showing a preferred embodiment of the present invention.

In FIG. 3, one embodiment of the invention which is preferred has been shown. Specifically, a core 30 which has a substantial width to thickness ratio is wrapped by a pair of wires 31 and 32 in the manner hereindescribed. A jacket means is provided to protect the coils and includes a pair of flat portions 34 covering the coils across the width of the core 30 and end portions 36 join the flat portions 124 such that at least a part thereof 35 is perpendicular to the first portion 124. Because of the particular configuration described, it is possible for the cable to flex or be bent along the width of the cable. Creases 37 are provided at spaced intervals along the jacket flat portions 34 to increase flexibility and assist in uniform curvature during installation.

Figure 4:
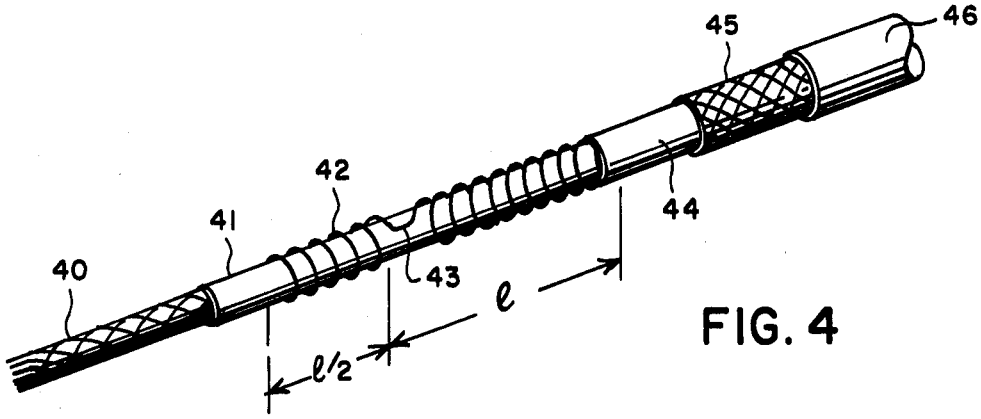
FIG. 4 is a partially sectioned cutaway schematic drawing showing another preferred embodiment of the present invention.

Similarly, as shown in FIG. 4, a wire core 40 is formed from a plurality of magnetostrictive wires woven together to form a substantially round core 40 of a significantly greater diameter than the diameter of the individual wires. Insulation means 41 is provided on top of the core 40. On top of the insulation means 41 is a wire 42 which forms windings such that each adjacent winding has a reverse polarity to the next adjacent winding. As has been stated previously, the windings at the first and second ends of the core have a length of L/2. X-1 windings of length L are provided in the interior portions of the transducer. X, of course, is an even integer of at least 2. In order to accomplish the reversal of polarity when one wire is employed, the wire 42 is reversed at 43 as shown in FIG. 4. A second insulation layer 44 may be employed to maintain the proper protection of the wire 42. A mesh 45 may be provided on top of the insulation 44 for additional strength, followed by an outer jacket 46 which may be conventional, environment proof wrapping.

Figure 5:
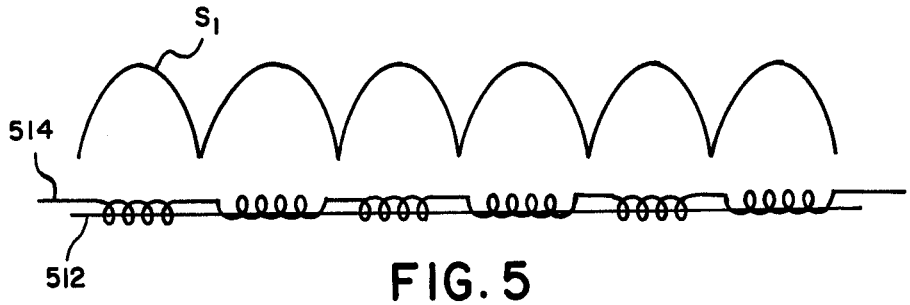
FIG. 5 is a schematic drawing showing the sensitivity of a single transducer.
Figure 6:
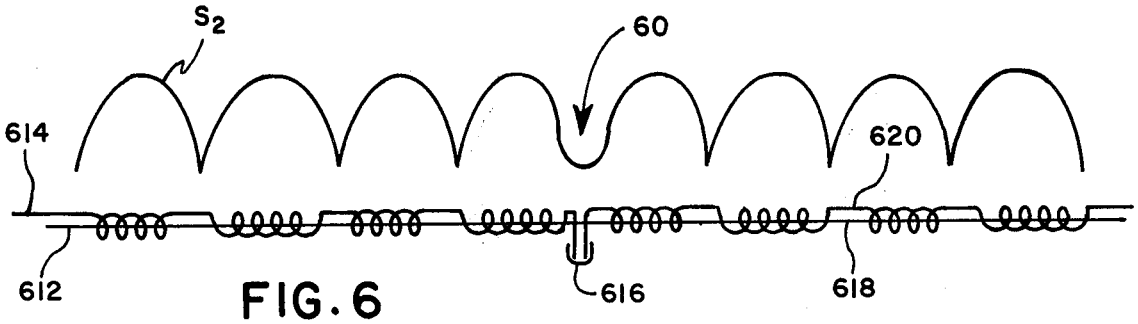
FIG. 6 is a schematic drawing showing the sensitivity of two transducers connected in a conventional manner.

In FIG. 5, the sensitivity $S_1$ of a transducer formed about core 512 by wrapping 514 through a series of windings is shown. By reversing the polarity of each adjacent winding with respect to the next adjacent winding, the sensitivity curve is as shown. In FIG. 6, two of the transducers shown on FIG. 5 are connected together through connector 616. Specifically, core 612 has a series of windings thereon formed by wire 614. The second core 618 has an additional series of alternating polarity windings on it formed by wire 620. The sensitivity $S_2$ of the two transducers connected in series through connector 616 is shown in FIG. 6. It should be noted that the portion by the connector 616 as shown by arrow 60 represents a substantial insensitive area where possible intrusion might be permitted without detection.

Figure 7:
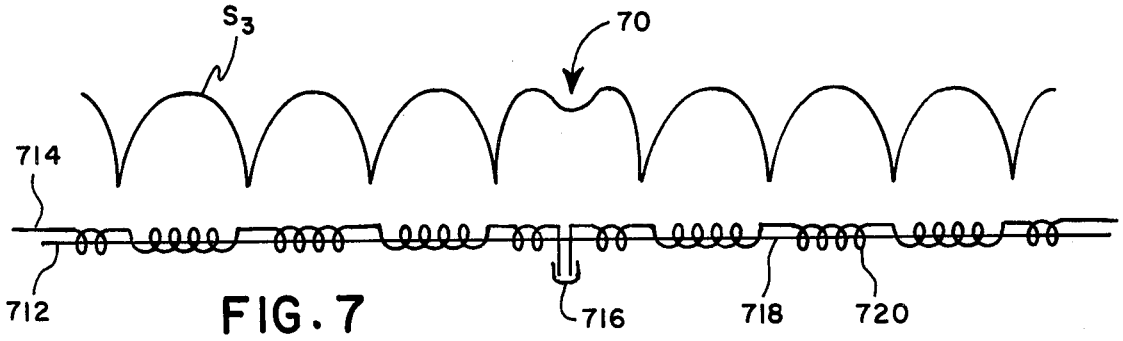
FIG. 7 is a schematic drawing showing the sensitivity of two transducers connected according to the principles of the present invention.

As shown in FIG. 7, a pair of cores 712 and 718 are joined together through connector 716. A first wire 714 wraps core 712. A second wire 720 wraps core 718. The sensitivity $S_3$ is shown for this combination of two sensors, and the reduction of sensitivity which occurs at the junction 716 is minimized because the detection functions at both sides of the connector are additive. Thus, the potential area of intrusion shown at 60 in FIG. 6 is not present at 70 in FIG. 7, and a more complete protection is afforded over the entire area to be protected.

Having thus described the invention, what is claimed is:

1. A plurality of transducers connected together, comprising:

a central core for each transducer extending along an axis and having a length along said axis defined as XL, where X is an even number of at least 2, and L is a given length;

at least one sensing winding wire wound around each said core to provide a first end winding of L/2 length, X-1 numbers of windings of length L, and a second end winding of L/2 length; each adjacent winding being of reverse polarity to the next adjacent winding;

means for connecting each transducer to the adjacent transducer such that the first end of one transducer connects to the second end of the adjacent transducer.

2. The device of claim 1, wherein said core is formed from a stress-sensitive magnetostrictive material.

3. The device of claim 1, wherein said core comprises a flat solid stress-sensitive magnetostrictive core having a substantial width to thickness ratio.

4. The device of claim 1, wherein said core comprises a plurality of magnetostrictive wires woven together to form a substantial round core of a significantly greater diameter than the diameter of the individual wires.

5. The device of claim 1, wherein X is at least 20 and L ranges from ½ meter to 4 meters.

6. The device of claim 3, which further includes jacketing means surrounding said coils on said core for preventing contact of said coils with external environment.

7. The device of claim 6, wherein said jacketing means includes a pair of flat portions covering said coils across the width of said core and end portions joining said pair of flat portions at both edges of said core, said end portions having at least a part thereof perpendicular to said first portions.

8. The device of claim 4, which further includes jacketing means surrounding said coils on said core for preventing contact of said coils with external environment.

9. The device of claim 1, wherein said wires are wound about said core at a predetermined tightness to permit magnetostrictive movement of said core.

10. The device of claim 1, wherein one sensing winding wire is wound around said core in alternating reversals of the windings to form first end winding, X-1 numbers of windings, and said second end winding.

11. The device of claim 1, wherein two sensing winding wires are alternately wound arounds said core to form first end winding, X-1 numbers of windings, and said second end winding.

12. The device of claim 1, wherein said plurality of transducers have windings that are comprised of from 2 to 40 turns per centimeter.

13. The device of claim 1, wherein at least one of said plurality of transducers has windings that are comprised of a substantially different number of turns per centimeter of length than the adjacent transducer windings.

* * * * *